United States Patent [19]

Hutter et al.

[11] Patent Number: 4,702,538

[45] Date of Patent: Oct. 27, 1987

[54] SHIELDED MODULAR CONNECTOR FOR USE WITH SHIELDED TWISTED PAIR CABLE

[75] Inventors: Harold G. Hutter, Brookfield; Dennis E. Tarrant, Bethel, both of Conn.

[73] Assignee: Amphenol Corporation, Wallingford, Conn.

[21] Appl. No.: 16,976

[22] Filed: Feb. 25, 1987

Related U.S. Application Data

[63] Continuation of Ser. No. 778,478, Sep. 20, 1985, abandoned.

[51] Int. Cl.[4] ..... H01R 13/28

[52] U.S. Cl. ..... 439/292; 439/417; 439/608

[58] Field of Search ..... 339/47 R, 48, 49 R, 339/49 B, 143 R, 98, 99 R

[56] References Cited

U.S. PATENT DOCUMENTS

| | | | |
|---|---|---|---|
| 4,153,326 | 5/1979 | Frantz et al. | 339/49 R |
| 4,272,148 | 6/1981 | Knack, Jr. | 339/143 R |
| 4,330,164 | 5/1982 | Pittman et al. | 339/49 R |
| 4,449,778 | 5/1984 | Lane | 339/143 R |
| 4,508,415 | 4/1985 | Bunnell | 339/143 R |
| 4,519,665 | 5/1985 | Althouse et al. | 339/143 R |

FOREIGN PATENT DOCUMENTS

| | | | |
|---|---|---|---|
| 2405464 | 8/1974 | Fed. Rep. of Germany | 339/49 R |

*Primary Examiner*—John McQuade
*Attorney, Agent, or Firm*—Bacon & Thomas

[57] ABSTRACT

The invention is a hermaphroditic modular connector. More specifically, the connector comprises a two-part modular housing which snaps together and which upon snapping together, effects connection of a twisted wire pair cable to a pair of insulation displacement contacts held within one part of the housing in a snap engagement by an insulator also in snap engagement held within the one part of the housing. Engaging extensions tabs project from the front of the connector in a manner such that the connector can be connected to a like connector without requiring additional parts or modification.

8 Claims, 10 Drawing Figures

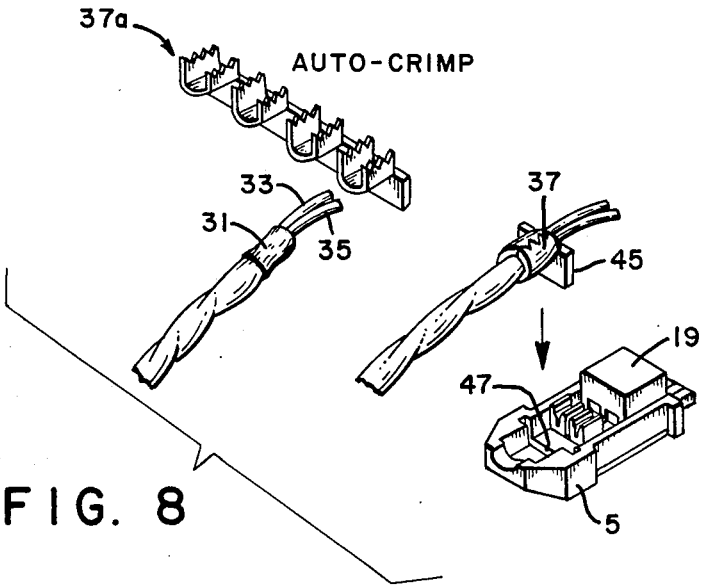
FIG. 8
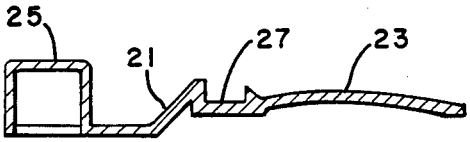
FIG. 9a
FIG. 9b
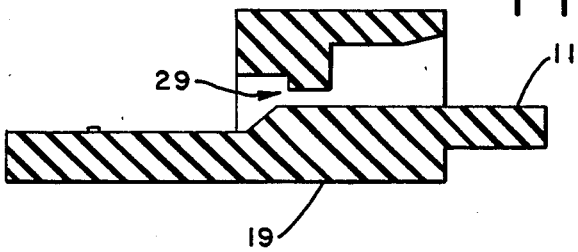

SHIELDED MODULAR CONNECTOR FOR USE WITH SHIELDED TWISTED PAIR CABLE

This application is a continuation of application Ser. No. 778,478, filed Sept. 20, 1985, now abandoned.

BACKGROUND OF THE INVENTION

This invention relates to a connector for use with shielded twisted pair cables. More particularly, the invention relates to such a connector for use with a shielded twisted pair cable which is of modular construction and easy to assemble. Further, the connector is hermaphrodic in nature, i.e., capable of being connected to a like connector in a simple snap action connection.

In the prior art there are a number of connector designs for use with shielded twisted pair cables. Most designs are typically made up of a number of components which must be very precisely machined. Further, the prior art typically involves the manufacturer of what is known as a "triax jack" for mating with a separate, and differently constructed "triax plug". Thus, it is seen that different constructions are required for effecting a connector assembly for use in connecting shielded twisted pair cables thereby further complicating the assembly requirements.

The above-discussed structures result in a number of disadvantages, the main one of which is substantial cost resulting from the requirement of providing a separate jack structure for mating with a plug of different structure. Moreover, the assembly of a number of different parts is complicated and often failures occur due to the precise machining requirements in manufacturing such assemblies.

SUMMARY OF THE INVENTION

It is thus an object of the present invention to provide a simple modular connector structure for use with shielded twisted pair cable.

It is another object of the present invention to provide such a modular connector structure of relatively few parts which can be easily manufactured and assembled in an operation of a small number of steps.

It is still another object of the present invention to provide such a connector structure which is hermaphroditic in nature and which is thus capable of connecting to a like connector structure.

It is still a further object of the present invention to provide such a connector which can be manufactured as a shielded connector for use in such applications when required.

These and other objects of the present invention will become more readily apparent from the following summary of the invention, detailed description and claims.

In accordance with the invention there is provided a shielded modular connector which comprises a housing comprised of first and second parts constructed for being snapped together to form the housing. Cable crimp means serves for being crimped onto a cable having at least two conductors and for being detachably held by a receiving assembly in at least one of the first and second parts making up the housing. Contacts are retained in at least one of the first and second parts and serve to establish electrical contact with the at least two conductors of the cable. The first and second parts include engaging structures of a shape such that, when assembled as a connector, the modular connector can be connected to a like modular connector for establishing electrical connection between respective cable means.

In a more specific aspect, the first and second parts are coated on the exterior thereof with a shielding material. More specifically, the coating is preferably nickel plating. In a still more specific aspect, the contact means is retained within one of the first and second parts by means of insulator means which also comprises a retaining means, the insulator means being snapped into one of the first and second parts for retaining the contacts therein.

Still further, the contacts are preferably a pair of insulation displacement contacts for establishing electrical connection with respective ones of the pair of insulation covered conductors of a cable. At the other end of the contacts there is a bowed portion which provides a resilient spring-like tension for connection to a like portion of a like contact. Preferably, the engaging means comprises a resilient tab extension from one of the first and second parts and a receiving recess on the other of the first and second parts which are of a shape and construction such that the resilient tab extension is capable of releasably engaging within the receiving recess of a like connector.

With respect to the materials employed for the insulator and the connector parts, it is preferably nylon or polyester with the specifically selected material for the two parts making up the housing being such as to be capable of being plated, preferably electroplated, on the exterior thereof to provide a shielded connector. A crimp ferrule is crimped over the cable and includes extensions for engaging portions of one of the two parts making up the housings for securely retaining the cable attached within the connector housing.

BRIEF DESCRIPTION OF THE DRAWINGS

Having briefly described the invention, the same will become better understood from the following detailed discussion of the invention made with reference to the attached drawings wherein:

FIG. 8 shows an alternative variation in the assembly steps for the connector which especially adapts the assembly to an automated operation, especially from the point of view of crimping and securing the cable to the connector assembly; and FIGS. 9A and 9B show the insulator and contact assembly in unassembled form and clearly illustrating how the contact is inserted and retained within the insulator.

DETAILED DISCUSSION OF THE INVENTION

Figure 1:
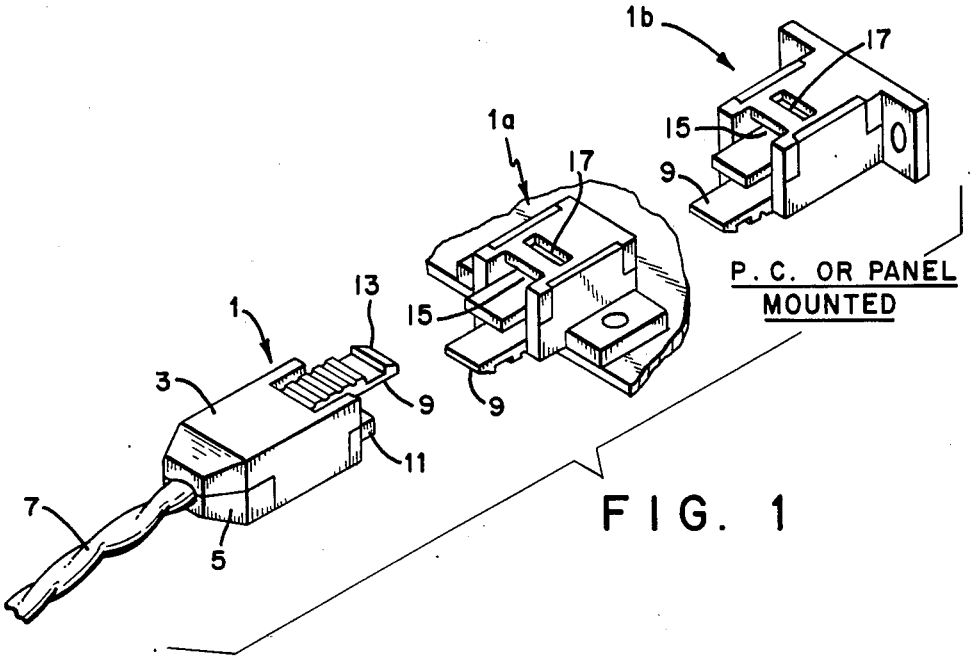
FIG. 1 shows in perspective view an assembled connector in accordance with the invention ready to be connected to a similar, but modified, connector structure, also in accordance with the basic principles of the invention.

In FIG. 1 there is shown a general connector assembly in accordance with the invention. The preferred embodiment is generally shown as connected to a twisted conductor pair cable 7 which is connected to the connector housing 1 which includes an upper portion 3 of the housing 1 connected in snap engagement with a lower portion 5 of the housing 1, and including an insulator 19 having an extension 11 for supporting contacts 21 which are connected to the conductors 33 and 35 of the cable 7 thereon. A tab extension 9, including an engaging portion 13, serves to engage a slot 17 through a passage 15 of a similar connector structure as shown as connector 1A. The connector 1A is a connector especially adapted for mounting on a PC, i.e., printed circuit, board and can also include an alternative construction as connector 1B which is adapted for mounting on a panel. In these cases it will be readily apparent that the basic components of the connector assembly will remain the same with the only modification being in the internal contact portions with respect to the connection to elements such as a printed circuit board or panel positioned at the back end of the connector housing 1. In the case of FIG. 1, it is also clearly seen that the connectors 1A or 1B will also include the tab extension 9 including the engaging portion 13 which will engage in a like passage 15 and slot 17 of the connector housing 1.

Figure 2:
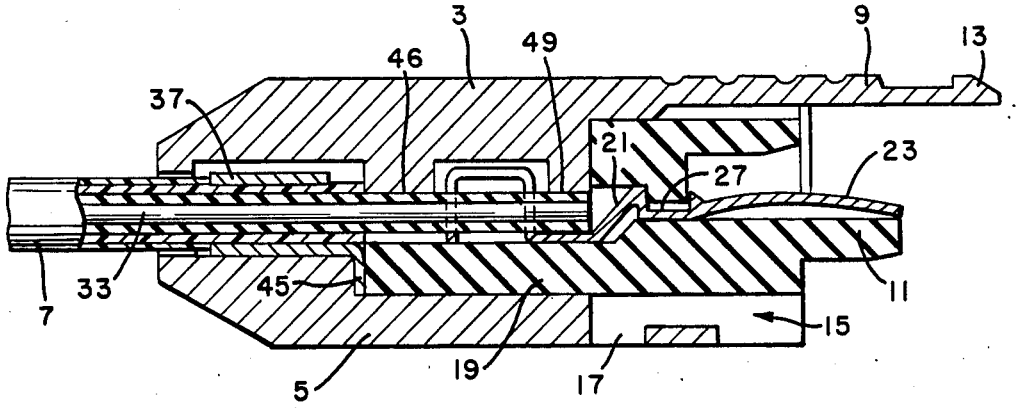
FIG. 2 is a side cross-sectional view of the preferred embodiment of the connector in accordance with the invention shown in assembled form.
Figure 3:
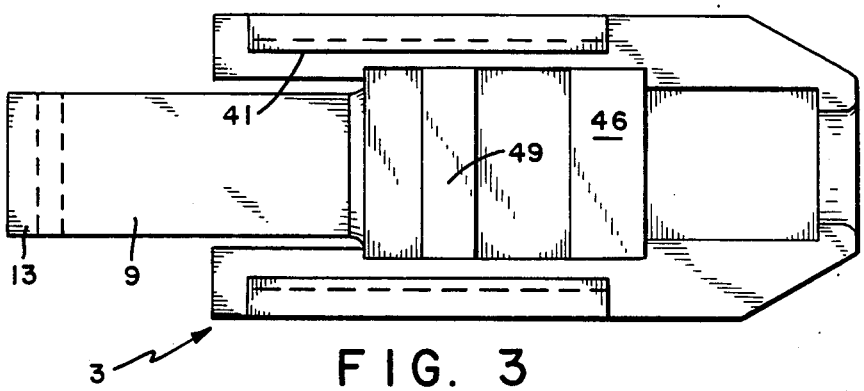
FIG. 3 is a bottom view of the top part of the connector which makes up part of the housing showing the interior structural features thereof.
Figure 4:
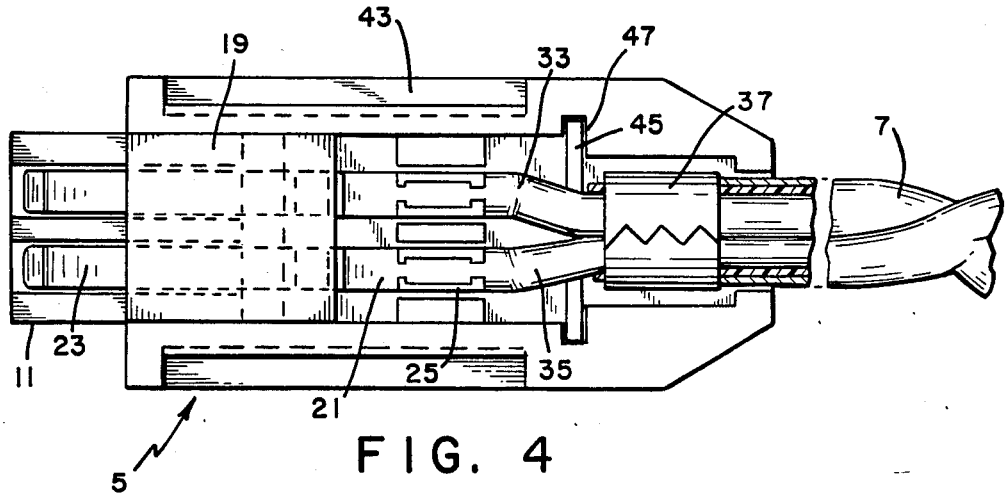
FIG. 4 is a top view of the bottom part of the housing showing a twisted conductor cable assembled therein with the crimp ferrule holding the cable within the bottom part, and further showing the connection with the electrical contacts thereof as retained within an insulator in the bottom part.
Figure 5:
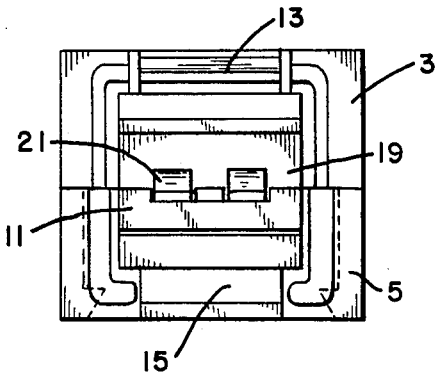
FIG. 5 is a front view showing the bowed contact portions of the connector from the connecting end.

As more clearly shown in FIGS. 2–4, the connector 1 in accordance with the preferred embodiment of the invention includes an upper portion 3 and a lower portion 5 which makes up the housing 1. The lower portion 5 houses an insulator 19 which serves to hold contacts 21 in fixedly engaged relationship with respect to the insulator 19. The insulator 19 is snapped into the body of the lower portion 5 prior to assembly of the connector housing 1 with a cable 7. The contact 21 is typically an insulation displacement type contact, i.e., IDC type, which includes an insulation displacement portion 25, as is well known to those of ordinary skill in the art, and a spring-loaded bowed contacting portion 23 at the end opposite the IDC portion. In between is an engaging portion 27 whose structure will be readily apparent to those of ordinary skill in the art from a viewing of FIGS. 2 and 9A.

In assembling the contacts into the insulator 19, as is more clearly shown in FIGS. 2, 9A, 9B and 7, the contact 21 is slid into the insulator 19 through a slot 29 whereby it will engage the insulator 19 at a narrow portion thereof at its engaging portion 27 of the contact 21.

The bowed portion 23, as clearly shown in FIG. 2, will be supported by insulator extension 11 such that when the connector 1 is connected a like connector it will engage in tension or spring-like relationship a like bowed portion 23 which is also supported on like extension 11.

Having previously assembled the contacts 21 into the insulator 19, the insulator is then snapped into engagement with the bottom portion 5 as is clearly shown in FIGS. 2, 4, 5, 7 and 8.

Figure 6:
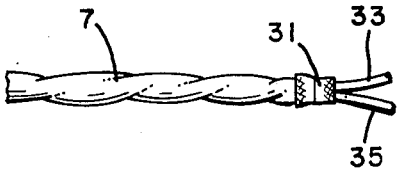
FIG. 6 is a side view of a typical twisted conductor cable assembly including a braided shield for use with the connector in accordance with the invention.
Figure 7:
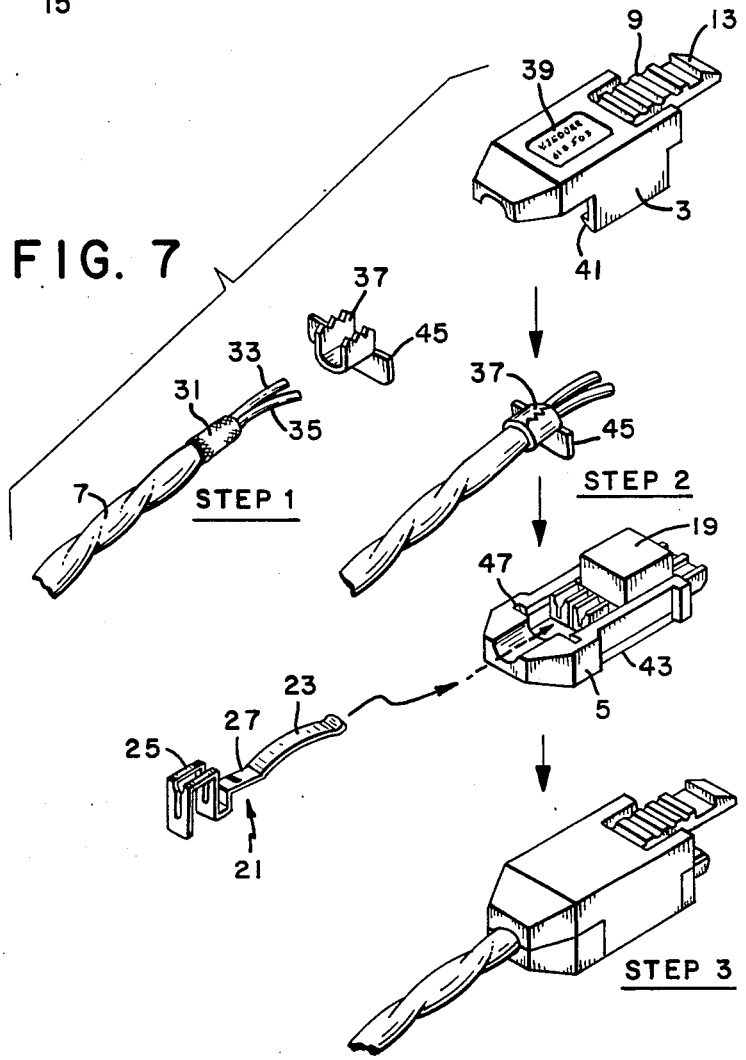
FIG. 7 illustrates in a blow-up unassembled perspective view the assembly operation for assembling the connector in accordance with one embodiment of the invention.

Thereafter, in order to assemble the connector as is shown in FIG. 7, the cable 7, which is shown in FIG. 6, and includes a shielding braid 31, is crimped at the shielding braid 31 by crimp ferrule 37. Thereafter the crimp ferrule 37 is inserted into the lower part 5 to engage at tab extension 45, the slots 47 in lower part 5. The upper part 3, which in FIG. 7 includes a portion 39 for placing a label or name thereon, is then snapped down onto the lower part 5 to retain the cable 7 therein.

In this context, it is noted that conductors 33 and 35 which are covered with insulation material are positioned over the insulation displacement contact portion 25 and when the cover 3 is snapped onto the bottom portion 5 as clearly evident from the drawings being held together by engagement between engagement parts 41 and 43, and, projections 47 and 49 as clearly shown in FIGS. 3 and 2, force the conductors 33 and 35 downwardly into the insulation displacing portion 25 to displace the insulation and effect electrical connection with the conductors 33 and 35. Once assembled, the projection of the bowed portions of the contacts 21 is more clearly shown in the front view of FIG. 5. Thereafter, the connector is ready to be connected to a PC or panel mounted like connector assembly. The engagement between said connector assemblies will be readily apparent from a viewing of FIGS. 1 and 2.

In a still more specific aspect, to facilitate automated assembly of the device, it is possible to include the crimp ferrules 37 as part of an automated assembly as interconnected ferrules assembly 37A with the individual ferrules 37 being automatically cutoff from said assembly 37A during assembly and then crimped onto the respective cables 7 as generally shown in FIG. 8.

With respect to the materials employed in practicing the invention, it should be noted that although it is preferred that nickel be used as an electroplating material on the exterior of connecting housing 1, any other material which can be electroplated onto the exterior of the connector housing 1, and which has a shielding effect can be used. Examples of such materials include tin, silver and gold, as well as any other like materials which shield sufficiently so as to not substantially affect transmissions through the cable, as will be readily apparent to those of ordinary skill in the art.

With respect to the materials used in manufacturing the parts 3 and 5 as well as the insulator 19, these are typically nylon or polyester materials or can be any other moldable plastic, typically of the thermoplastic materials classes. In this regard, with respect to the parts 3 and 5, it is necessary that they be electroplatable or generally platable on the exterior thereof. This is not a requirement for the insulator 19.

With respect to the contacts, it is preferred that they be of conductive brass-type alloy as is well known to those of ordinary skill in the art. Alternatively, other conductive materials which can be employed include beryllium copper alloys, it only being necessary that the materials be sufficiently conductive while strong enough to provide a spring effect at the bowed portion 23 and sharp enough to displace the insulation on the conductors 33 and 35.

While particular embodiments of the present invention have been shown and described, it will be obvious to those skilled in the art that various changes and modifications may be made without the departing from the scope of the invention and its aspects. Accordingly, the aim of the appended claims is to cover all such changes and modifications as may fall within the true spirit and scope of the invention.

What is claimed is:

1. A shielded modular connector comprising:

a housing comprised of first and second parts constructed for being snapped together into engagement, one of the housing parts constructed such that insulation displacement contacts can be inserted and snapped thereinto to be retained thereby with the contact portion thereof being in a spring loaded bowed contact condition against a surface of the one part, and the other part having a press projection for forcing conductors into electrical contact with insulation displacement contacts received in the one part;

cable crimp means for crimping onto a cable having individual conductors, and constructed for being detachably held by receiving means in the one part of the housing constructed for retaining insulation displacement contacts;

insulation displacement contacts shaped for being received and retained in said one housing part, said contacts having contact portions such that when received in said first housing part the contact portions are in spring loaded condition, and having insulation displacement portions thereof in a position for having conductors forced into engagement therewith by the other housing part press projection when the first and second housing parts are snapped together;

retaining means comprising part of said one housing and shaped for being snapped into engagement therewith for retaining said insulation displacement contacts therein; and said first and second parts having engaging means of a shape such that, when assembled, said modular connector can be connected to a like modular connector for establishing electrical interconnection between a pair of cables, and said first and second parts being coated on the exterior thereof with a shielding material.

2. A connector as in claim 1 wherein said coating is nickel plating.

3. A connector as in claim 1 wherein said insulation displacement contacts comprise at least a pair of insulation displacement contacts for establishing electrical connection with respective ones of a pair of insulation covered conductors of a cable.

4. A connector as in claim 1 wherein said engaging means comprises a resilient tab extension from one of said first and second parts and a receiving recess on the other of said first and second parts of a shape and construction such that said resilient tab extension is capable of releasably engaging within said receiving recess.

5. A connector as in claim 3 wherein said spring loaded contact portion of each said insulation displacement contact extends toward the end of the connector away from a cable connected thereto for contacting a contact of another connector when connected thereto.

6. A connector as in claim 1 wherein said first and second parts are made of nylon and are electroplated on the exterior with nickel to provide a shielded connected when assembled.

7. A connector as in claim 1 wherein said first and second parts are made of polyester and are electroplated with nickel to provide a shielded connector when assembled.

8. A connector as in claim 1 said cable crimp means comprises a crimp ferrule having two extensions along the sides thereof, and said one part of the housing having receiving means which comprises respective slots in the interior sidewalls thereof for slidably receiving said extensions of said crimp ferrule.

* * * * *